United States Patent [19]

Sunderland

[11] 3,943,741

[45] Mar. 16, 1976

[54] EMBOSSING METHOD

[75] Inventor: Willis W. Sunderland, Worthington, Ohio

[73] Assignee: The United States of America as represented by the Secretary of the Army, Washington, D.C.

[22] Filed: Mar. 25, 1975

[21] Appl. No.: 561,754

[52] U.S. Cl. ..... 72/57; 72/58; 72/62; 72/358

[51] Int. Cl.[2] ..... B21D 26/04

[58] Field of Search ..... 72/58, 59, 62, 57, 348, 72/356, 358, 359

[56] References Cited

UNITED STATES PATENTS

| | | | |
|---|---|---|---|
| 1,199,414 | 9/1916 | Pomeroy | 72/62 X |
| 3,056,197 | 10/1952 | Lawson | 72/356 |
| 3,698,221 | 10/1972 | Couland | 72/62 |

*Primary Examiner*—Milton S. Mehr

*Attorney, Agent, or Firm*—Nathan Edelberg; Robert P. Gibson; Thomas R. Webb

[57] ABSTRACT

A cup-shaped blank is extruded through a die onto a cylindrical non-collapsible mandrel having an external surface pattern counter to a desired internal embossment. Subsequently, the embossed portion of the blank is hydrostatically expanded away from the mandrel to permit removal of the embossed part from the mandrel. The application of hydrostatic pressure to the exterior of the blank during the extruding operation is disclosed.

8 Claims, 6 Drawing Figures

EMBOSSING METHOD

GOVERNMENT INTEREST

The invention described herein was made under a contract with the Government.

BACKGROUND AND SUMMARY OF THE INVENTION

The present invention relates to a new and improved method of embossing metal parts, and particularly to an embossing method using a non-collapsible mandrel.

Generally, an internally-embossed tubular or cup-shaped part is made by extruding a blank with a pre-embossed surface through a die onto a smooth mandrel. This method causes distortion of the embossed portion during the forming operation.

In accordance with the present invention, the desired embossed part is made by extruding a smooth-surfaced preformed blank through a die onto a non-collapsible mandrel having an external surface counter to the desired internal embossment, and hydrostatically expanding the embossed blank, or an embossed portion thereof, from the mandrel, permitting removal of the part and forming an undistorted embossed pattern on the internal surface, or portion thereof, of certain tubular or cup-shaped parts. The step of extruding the blank through the die onto the patterned mandrel may include the application of hydrostatic pressure to the exterior of the blank.

WRITTEN DESCRIPTION OF A PREFERRED EMBODIMENT

Figure 1:
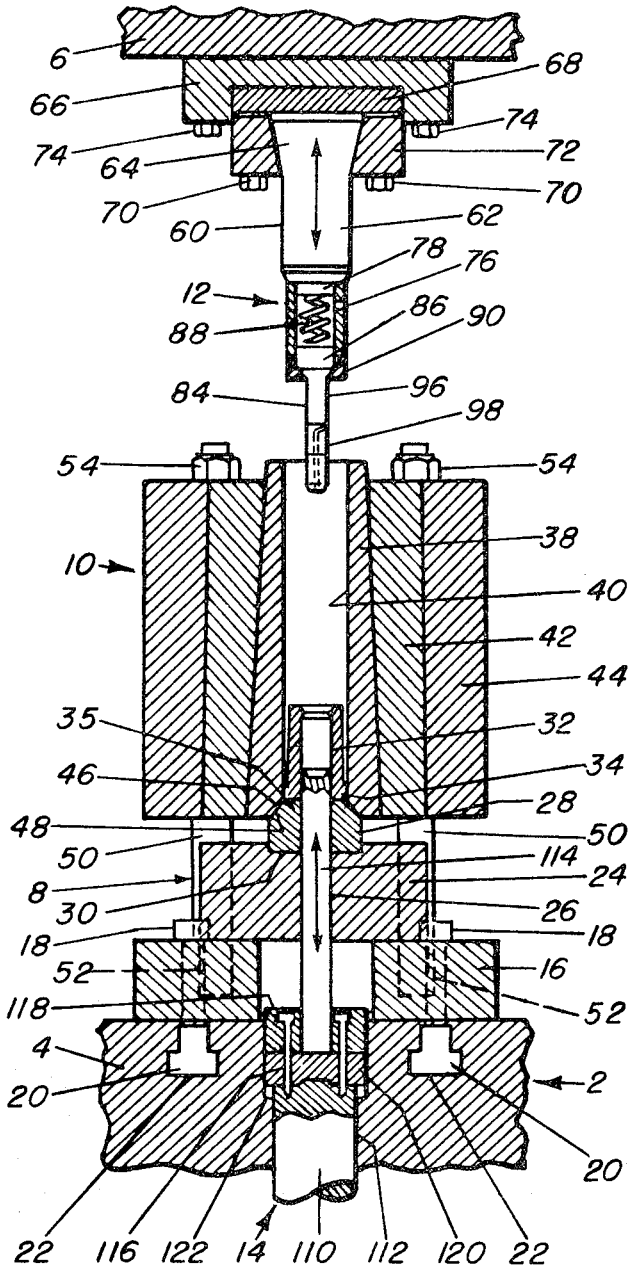
FIG. 1 is a vertical axial section view of the tooling installed in a hydraulic double-action vertical press that can be used to practice the present invention.

FIGS. 1 to 4 illustrate the principal tooling parts in a 700-ton hydraulic double-action vertical press 2 which may be used to reduce the present invention to practice. The press 2 comprises a steel frame including a fixed lower platen 4, an upper platen 6, and conventional hydraulic means (not shown) for moving the upper platen 6 vertically with respect to the lower platen 4.

The tooling assembly mounted on the two platens 4 and 6 comprises four sub-assemblies:

1. a die sub-assembly 8;
2. a high pressure container sub-assembly 10;
3. an upper stem sub-assembly 12; and
4. a lower stem sub-assembly 14.

The die sub-assembly 8 comprises a horseshoe-shaped bearing plate or disc 16 adjustably mounted on the lower platen 4 by means of four bolts 18 extending through bearing plate 16 and threaded into four T-nuts 20 slidably mounted in two T-shaped channels 22 formed in the lower platen 4, a die support block or disc 24 resting on the bearing plate 16 and having a central aperture 26, a die support ring 28 seated in a shallow recess 30 in the support block 24, and a hollow extrusion die 32 having an enlarged lower end portion 34 abutting the upper end 35 of the ring 28 of the same diameter. The die 32 is formed with a cylindrical bore 36 having a diameter approximately equal to the outer diameter of the finished part and is terminated at the upper end by a smaller-diameter internal land 37 which forms the die orifice.

The container sub-assembly 10 comprises an inner liner 38 having a cylindrical bore 40 in which the die 32 and upper end 35 of ring 28 are fitted, surrounded by supporting rings 42 and 44. The lower end of the liner 38 is beveled, at 46, to engage a complementary bevel 48 on the die support ring 28, for supporting the liner 38 on the ring. The outer wall of the liner 38 and the inner wall of the ring 42 are tapered complementally, outward and downward, and the outer wall of the ring 42 and the inner wall of ring 44 may also be tapered, as shown in FIG. 1, and machined to produce an interference fit upon assembly of the liner 38, container ring 42 and container ring 44 forming a rigid container capable of withstanding high fluid pressure within the liner 38. The outer ring 44 is clamped to the bearing plate 16 by four studs 50, threaded into the bearing plate 16 at 52, and four nuts 54. A fluid seal between the die 32 and the liner 38 is provided by a metal miter ring 56 and a rubber O-ring 58 at the juncture between the larger end portion 34 and the smaller main body portion of the die 32.

The upper stem sub-assembly 12 comprises an upper stem 60 including a cylindrical lower portion 62, which is slidable in the bore 40 of the liner 38, and a tapered upper portion 64 which is clamped to a stem support block 66, with an intermediate pressure plate 68, by means of six bolts 70 and a tapered collar 72. The stem support block 66 is attached to the upper platen 6 by bolts 74. The upper stem sub-assembly 12 performs two functions, (1) to pressurize the fluid media, and (2) to permit independent movement of the mandrel relative to the stem during pressurization of the fluid and deformation of the blank. Therefore, a hollow cylindrical stem extension 76 is threadedly attached to a reduced-diameter end 78 of the stem 60. Preferably, the outer diameter of the extension 76 is less than that of the liner bore 40, to provide a space for placing seals on the upper stem 60 without disassembling the lower portion of the stem sub-assembly 12. The upper end of this space is sealed by a metal miter ring 80 and a rubber O-ring 82. A mandrel 84 is slidably mounted on the stem extension 76 by means of an enlarged head 86 slidable therewithin. The head 86 is formed with one or more axial vent holes 87, allowing passage of fluid as the upper stem sub-assembly 12 moves downward during pressurization of the fluid. The mandrel 84 is retained within the extension 76, against the bias of a coil spring 88, by means of a threaded collar 90 having vent holes 92 for fluid to pass. A radial vent opening 94 connects the interior of the hollow stem extension 76 with the surrounding fluid space. The mandrel is preferably made up of two detachably-connected parts, namely, an upper guide part 96, integral with the head 86 and slidable in the collar 90, and a lower non-collapsible working part 98. A cylindrical portion 100 of the lower working part 98 is formed with an external surface pattern 102, shown schematically in FIGS. 3 and 4 as a crossed-grid pattern, which is counter (inverse) to the pattern of the desired internal embossment to be formed on a cylindrical portion 105 of a cup-shaped blank 103. In the example shown, the cylindrical portion 100 is spaced from the lower end of the mandrel part 98 by a reduced-diameter tapered end portion 104. The space between the collar 90 and the die 32, together with the spaces between the die 32 and extension 76 and the liner 38, and the space within the stem extension 76, form a variable-volume chamber 106 containing a fluid for applying hydrostatic pressure to the blank 103 during the extruding operation. The working mandrel part 98 is formed with an axial bore 107 and a connecting transverse bore 108 to provide a passageway for fluid between the chamber 106 and the interface between the mandrel part 98 and the blank 103 at the lower end thereof.

The lower stem sub-assembly 14 comprises a lower stem 110, which is slidable in a vertical bore 112 in the lower platen 4, and an elongated cylindrical support rod 114, which is vertically slidable in the die support block 24, the die support ring 28 and the die bore 36 and is attached, as by bolts 116, collar 118 and plate 120, to the upper end of the lower stem 110. In the example shown, the collar 118 and plate 120 are slidable in a counterbore 122 in the lower platen 4. The press 2 includes conventional hydraulic means (not shown) for moving the lower stem 110 vertically in the lower platen 4. The upper end 124 of the support rod 114 is formed with a tapered-wall recess 126 which is complemental to the tapered end 104 of the mandrel part 98, for supporting a complemental base portion 128 of the cup-shaped blank 103 during the extrusion and subsequent expansion operations. Each of the upper and lower stem sub-assemblies may include a load cell for measurement of the existing loads.

Figure 2:
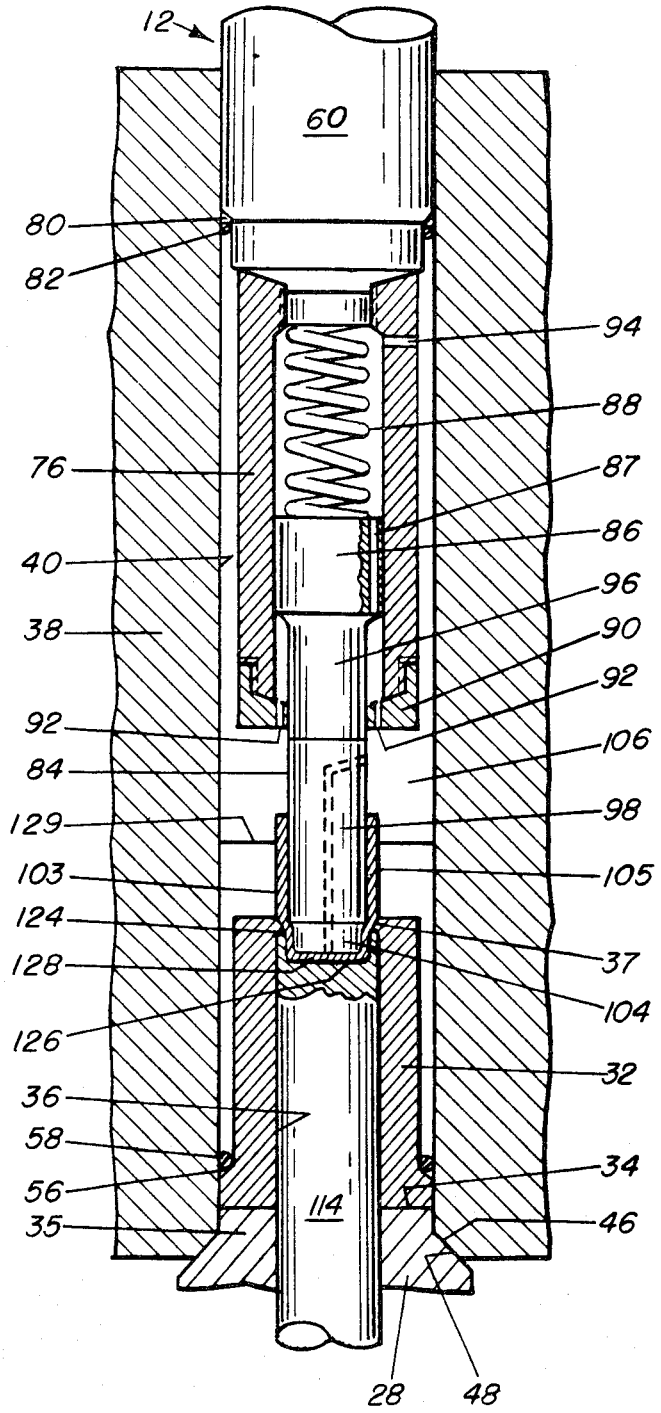
FIG. 2 is an enlarged section view of a portion of the tooling in FIG. 1, at the beginning of the extruding operation.

The press shown and described may be operated as follows. The starting work-piece may be a pre-formed cup-shaped steel blank, which may be preformed by (1) conventional cold deep-drawing to yield a dished cup and then forming the cup to final shape, or (2) hydrostatically forming a straight wall cup from a flat blank and then forming the reduced base portion 128 of the blank 103 by coining. Preferably, the cylindrical portion 105 of the blank 103 should have an internal diameter such that the blank will have a frictional fit on the mandrel pattern 102. In operation, (1) the upper platen 6 and the upper stem assembly 12 of FIG. 1 are raised; (2) the preformed cup-shaped blank 103 is placed over the mandrel part 98, with the support rod 114, with a preset load, in its uppermost position wherein the rod end 124 engages the lower edge of the die land 37, as shown in FIG. 2; and (3) a predetermined quantity of a suitable hydraulic fluid, is dispensed into the chamber 106, filling it to a level 129. The correct amount of fluid to be used depends upon its compressibility, and can be predetermined by experiment.

Figure 3:
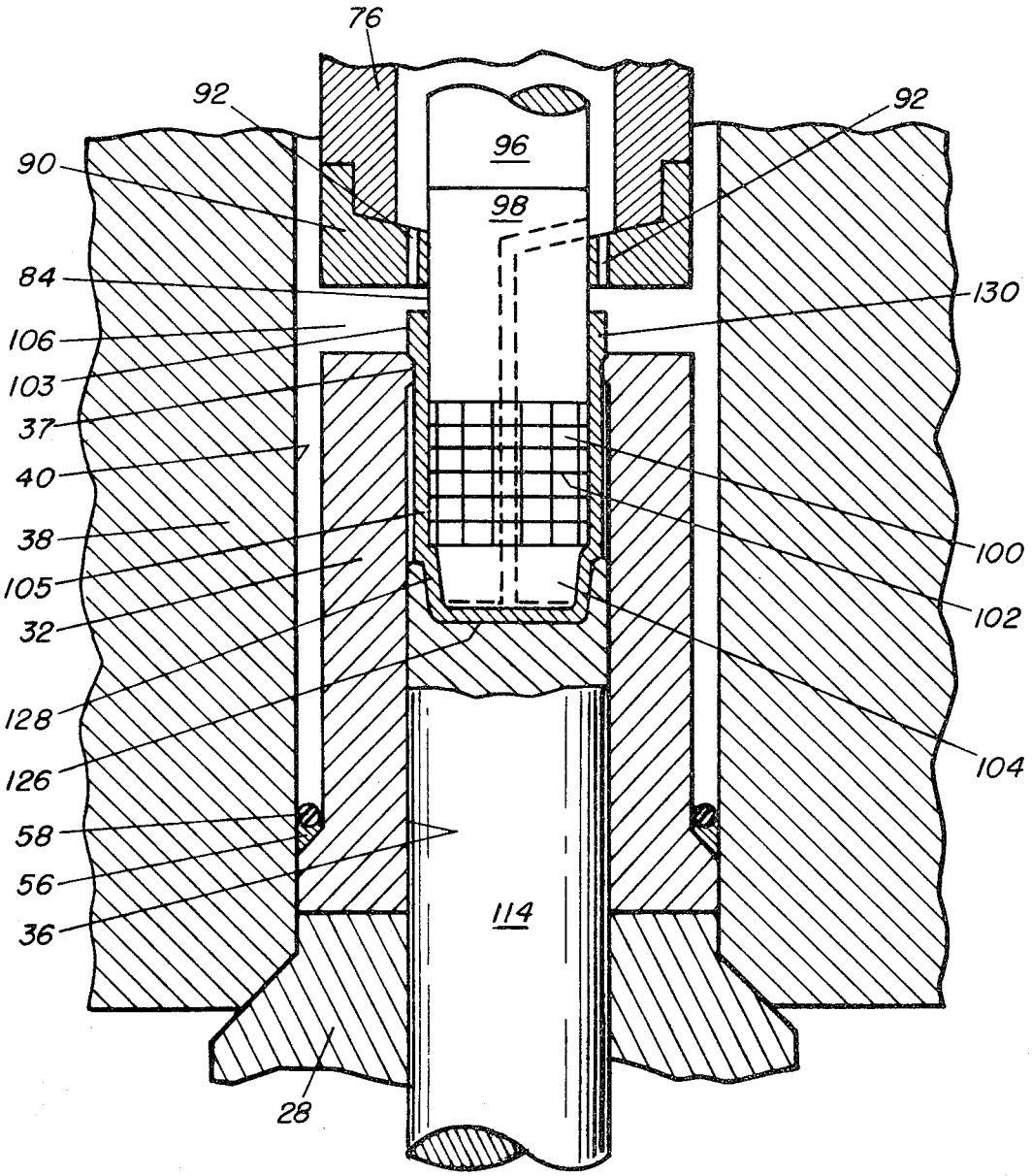
FIG. 3 is a still further enlarged section view, similar to FIG. 2, near the end of the extruding operation.

Next, the stem 60 is lowered to seat the tapered end portion 128 of the blank 103 in the tapered recess 126 of support rod 114 and bring the cylindrical portion 105 of the blank 103 into contact with the die land 37. On further downward movement of the stem 60, the mandrel 84 and blank 103 are supported by the rod 114 (and its hydraulic means) and the die land 37, and hence, the bias spring 88 is compressed, firmly seating the mandrel 84 and blank 103 against the support rod 114 and the die land 37 during fluid pressurization. This pressure is produced by downward movement of the upper stem sub-assembly 12 on the fluid in chamber 106 both during the extrusion operation and after the mandrel 84 is stopped by the support rod 114. Before the stem 60 reaches the position shown in FIG. 3, the variable-volume chamber 106 has become completely full, and the hydrostatic pressure therein increased sufficiently to produce plastic flow of the blank material, the upward force on the support rod 114, which was greater than the deformation pressure required to extrude the blank material, was gradually reduced to permit the mandrel 84 and blank 103 to advance through the die land 37. During this extrusion, the wall 105 of the blank 103 is forced inwardly, embedding the pattern 102 of the mandrel portion 100 into the inner surface of the blank 103. FIG. 3 shows the parts when the extrusion is almost complete, with an unextruded lip 130. For this extrusion operation, the parts should be chosen so that the difference between the radii of the die land 37 and the base of mandrel pattern 102 (bottom of the grooves) is less than the original thickness of the cylindrical portion 105 of the blank 103, in order to produce complete embossment of the blank. The extrusion operation will result in some elongation of the blank, which must be taken into consideration. The thickness and diameter of the starting blank 103 can be varied over a limited range to give the desired cup dimensions. Heavier wall reductions require higher extrusion pressures.

Figure 4:
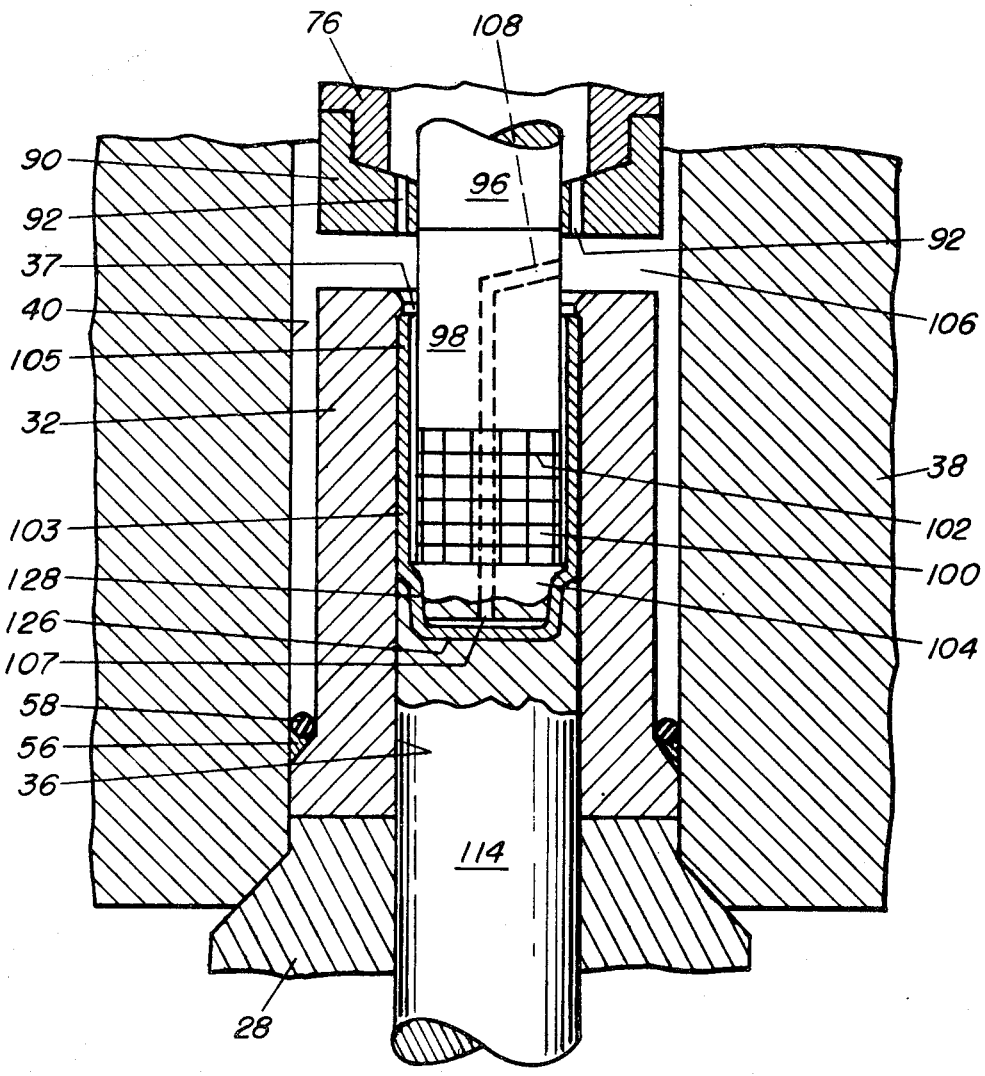
FIG. 4 is a similar section view at the end of the expanding operation.

The downward movement of the mandrel 84 is terminated, as by the stem plate 120 engaging the stop formed by the base of the counterbore 122, when the extrusion is completed and the blank 103 is completely within the cylindrical bore 36 (below the die land 37) as shown in FIG. 4.

The embossed blank 103 is released from the patterned mandrel for removal therefrom by expanding the cylindrical portion 105 outwardly, away from the mandrel, by hydrostatic pressure transmitted from the chamber 106, through the two bores 107 and 108, to the interface between the mandrel part 98 and the embossed blank 103, as shown in FIG. 4. Here, expansion of the blank 103 from the mandrel 84 is completed. Some of this expansion of the blank away from the mandrel may occur during the extrusion step in those portions of the blank that have already passed the die land 37 and are no longer subjected to the exterior hydrostatic fluid pressure of chamber 106.

After the finished cup 103 has been fully released from the mandrel, as shown in FIG. 4, the cup may be removed from the container 10 by first removing the mandrel 84, by raising the upper platen 6 and upper stem sub-assembly 13, and then removing the die 32 (upwardly) from the container (by a suitable tool) and pushing the cup downwardly out of the die. As an alternative, the fixed stop 122 for the lower stem 110 may be replaced by a stop that can be moved to release and permit withdrawal of the entire lower stem sub-assembly 14 and the embossed cup 103 downwardly from the die sub-assembly 8.

The various parts of the four tooling sub-assemblies of the press may be made from suitable steels or other strong hard metals or alloys. The starting blanks may, for example, be made from AISI 4140 steel. Castor oil is a suitable hydraulic fluid. The metal miter rings 56 and 80 may be made from AISI 4340 steel heat-treated to a hardness of about $R_C$40. A different number of container rings may be used in the design of the container sub-assembly 10, dependent upon fluid pressure requirements to extrude, emboss, and/or expand a specific material from the mandrel.

The blanks may be internally embossed and hydrostatically expanded on the same press by hydrostatic means, as described above, or different presses may be used. Where the first step, or embossing operation, is performed by conventional extrusion, as shown in FIGS. 5 and 6, the step of expanding an embossed cup to release it from the mandrel may be completed in the manner shown in FIG. 4.

Figure 6:
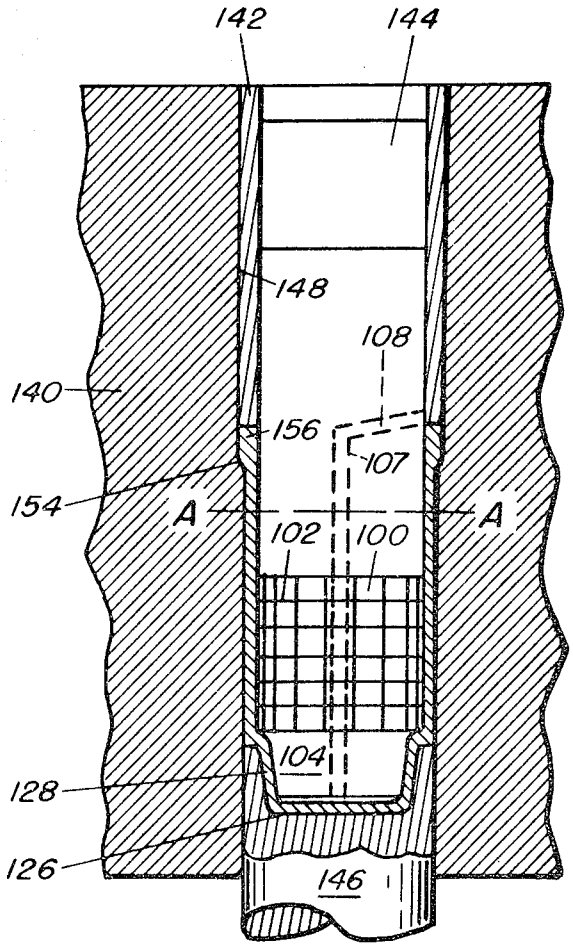
FIG. 6 is a similar section view at the end of the extruding step.
Figure 5:
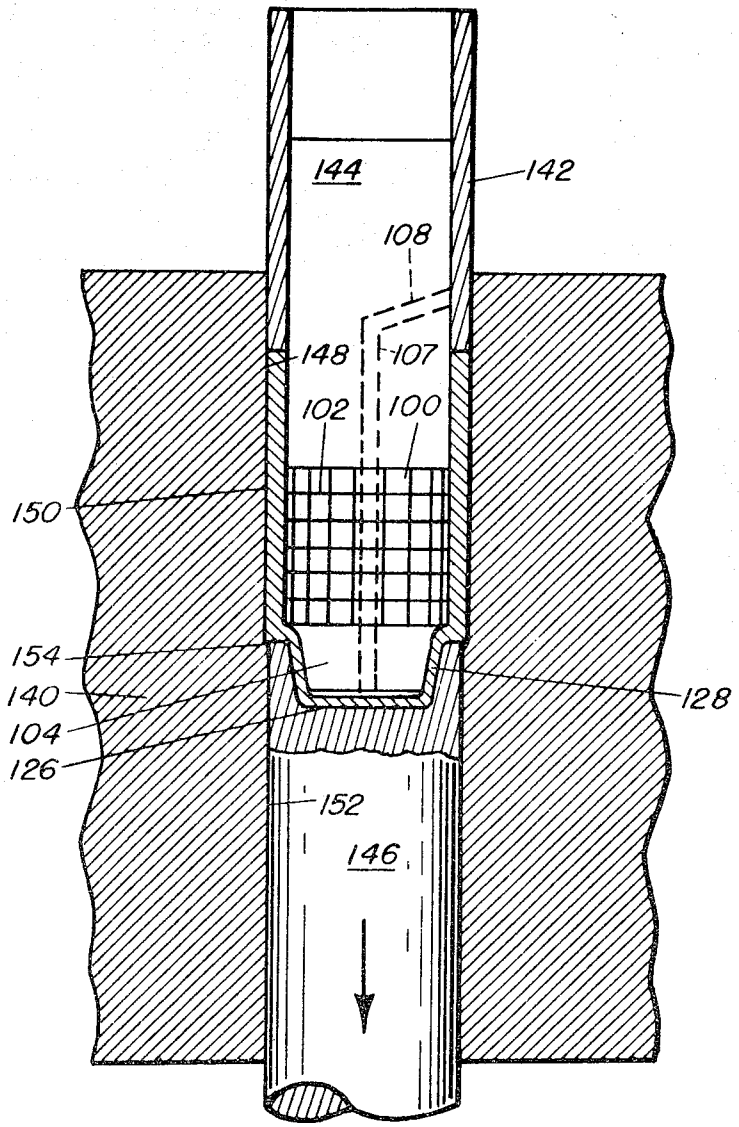
FIG. 5 is an enlarged section view similar to FIG. 3 at the beginning of the embossing extrusion step of an alternate two-step method of producing the desired part.

FIGS. 5 and 6 show an alternative tooling assembly that can be used for the embossing operation. The assembly comprises a die 140 which is mounted on the lower platen of a press (not shown), a hollow cylindrical ram 142 mounted on the movable upper platen of the press, a cylindrical mandrel 144 slidable in the ram 142, and a support rod 146 mounted on the lower stem for movement by hydraulic means (not shown) like the rod 114 in FIGS. 1–4. The die 140 is formed with an upper bore 148 for slidably receiving the hollow ram 142 and the preformed blank 150, which may be identical with the blank 103 of FIGS. 1–4, and a lower bore 152 of slightly smaller diameter, essentially a long die land, slidably receiving the support rod 146, joined by a short chamfer 154. The mandrel 144 includes a cylindrical portion 100 formed with an external surface pattern 102, for embossing the blank 150, as in FIGS. 1–4. The difference in diameter of the bores 148 and 152 should be sufficient to cause the pattern 102 to be fully embossed in the blank 150. The upper end of the support rod 146 has a tapered-wall recess 126 for receiving the tapered end 104 of the mandrel 144 and the complemental base portion 128 of the blank 150.

In operation, the parts are assembled as shown in FIG. 5 with the blank 150 and mandrel 144 inserted in the die 140. The hollow ram 142 is forced downward by its hydraulic means (not shown) generating pressure between the chamfer 154 and the lower end of the blank 150. When this pressure is sufficient to cause plastic flow of the blank material, the blank 150 is extruded into the lower bore 152 of the die 140 and onto the patterned mandrel, retaining the unextruded lip 156, as shown in FIG. 6. Use of the support rod 114 is optional in this instance. After the extrusion and embossing are completed, the hollow ram 142 is retracted, and the mandrel 144 and embossed blank 150 are ejected from the die 140 by the support rod 146. Then, the mandrel 144, with the embossed blank 150 attached thereto, is placed in a different press including the die 32 and support rod 114 of FIG. 4, to complete the extrusion of the cup lip 156 and to expand the embossed wall of the blank away from the mandrel by hydrostatic means as shown in FIGS. 3 and 4.

For an example, preformed smooth-wall cup-shaped blanks of AISI 4140 steel, having an outside diameter of about 1.52 inches and a wall thickness of about 0.125 inch, have been embossed by the method illustrated in FIGS. 5 and 6 to produce finished cups having a maximum thickness (at the embossment) of about 0.108 inch and an embossment groove depth of about 0.016 inch, and then expanded by hydrostatic pressure as described above to release the blank from the mandrel.

The foregoing disclosure and drawings are merely illustrative of the principles of this invention and are not to be interpreted in a limiting sense. I wish it to be understood that I do not desire to be limited to exact details of construction shown and described, because obvious modifications will occur to a person skilled in the art.

What is claimed is:

1. A method of forming a hollow metal part having a desired internal embossment, comprises the steps of:

extruding a hollow blank through a die onto a non-collapsible cylindrical mandrel having an external surface pattern counter to the desired embossment in said part, to emboss a portion of the blank; and hydrostatically expanding the embossed portion of said blank outward away from said mandrel, to release the blank from the mandrel for removal therefrom.

2. The method of claim 1, wherein the extruding step comprises the steps of:

placing a preformed cup-shaped blank, having an inner diameter substantially equal to that of said part and a thickness slightly greater than that of said part, on a patterned mandrel having an outer diameter substantially equal to said inner diameter; and forcing said blank and mandrel through a die having a circular extrusion orifice slightly smaller than the outer diameter of said blank, to extrude said blank onto said mandrel and form the desired internal embossment in said blank.

3. The method of claim 2, wherein hydrostatic pressure is applied to the exterior of said blank during the extruding step.

4. The method of claim 2, wherein said blank is forced through said die orifice by means of a hollow cylindrical ram.

5. The method of claim 2, wherein:

said die is formed with a cylindrical cavity, coaxial with, adjacent to, and slightly larger than said extrusion orifice, to permit outward expansion of said blank after extrusion; and at least the embossed portion of said blank is expanded away from said mandrel and into said cavity.

6. The method of claim 5, wherein said portion is expanded by applying hydrostatic pressure to the interface between said mandrel and said blank.

7. The method of claim 6, wherein said pressure is applied, from a high pressure fluid reservoir, through a passageway extending through said mandrel, to the base of said extruded cup-shaped blank.

8. The method of claim 2, wherein the base of said cup-shaped blank is supported on said mandrel during both the extruding and expanding steps by a cylindrical support member slidably mounted in said die and having an end face contoured to fit said base.

* * * * *